US005999784A

United States Patent [19]

Tsukida et al.

[11] Patent Number: 5,999,784

[45] Date of Patent: Dec. 7, 1999

[54] IMAGE FORMING APPARATUS WITH FIRST AND SECOND CHARGING MEMBERS

[75] Inventors: Shinichi Tsukida, Yono; Kimitaka Ichinose, Susono, both of Japan

[73] Assignee: Canon Kabushiki Kaisha, Tokyo, Japan

[21] Appl. No.: 09/124,228

[22] Filed: Jul. 29, 1998

[30] Foreign Application Priority Data

Aug. 4, 1997 [JP] Japan ..... 9-209494

[51] Int. Cl.[6] ..... G03G 15/16

[52] U.S. Cl. ..... 399/297; 399/298; 399/302

[58] Field of Search ..... 399/297, 298, 399/302, 303, 308, 310, 313, 314, 101, 115, 176, 168, 169, 227, 231, 232

[56] References Cited

U.S. PATENT DOCUMENTS

| | | | |
|---|---|---|---|
| 5,264,902 | 11/1993 | Suwa et al. | 399/333 |
| 5,450,181 | 9/1995 | Tsukida et al. | 399/322 |
| 5,572,306 | 11/1996 | Goto et al. | 399/69 |
| 5,732,310 | 3/1998 | Hiroshima et al. | 399/101 |
| 5,752,130 | 5/1998 | Tanaka et al. | 399/101 |

*Primary Examiner*—Arthur T. Grimley
*Assistant Examiner*—Hoan Tran
*Attorney, Agent, or Firm*—Fitzpatrick, Cella, Harper & Scinto

[57] ABSTRACT

An image forming apparatus has an image bearing member, an image forming unit for forming a toner image on the image bearing member and having a first charge member for charging the image bearing member, a rotatable intermediate transfer member onto which the toner image on the image bearing member is transferred at a first transfer position, the toner image on the intermediate transfer member being transferred onto a transfer material at a second transfer position, and a second charge member for charging residual toner remaining on the intermediate transfer member, the second charge member charging the residual toner on the intermediate transfer member with polarity opposite to charging polarity of the first charge member for charging the image bearing member, after the toner image is transferred from the intermediate transfer member to the transfer material. At the first transfer position, an electric field for transferring the residual toner on the intermediate transfer member charged by the second charge member onto the image bearing member is generated, and a charging area of the second charge member in a longitudinal direction thereof is disposed internally of a longitudinal charging area of the first charge member.

17 Claims, 9 Drawing Sheets

$$SF1 = \frac{(MXLNG)^2}{AREA} \times \frac{\pi}{4} \times 100$$

$$SF2 = \frac{(PERI)^2}{AREA} \times \frac{\pi}{4} \times 100$$

IMAGE FORMING APPARATUS WITH FIRST AND SECOND CHARGING MEMBERS

BACKGROUND OF THE INVENTION

1. Field of the Invention

The present invention relates to an image forming apparatus such as an electrophotographic copying machine, an electrophotographic printer and the like, and more particularly, it relates to an image forming apparatus using an intermediate transfer member.

2. Related Background Art

FIG. 11 is a schematic constructural view of a conventional image forming apparatus using an intermediate transfer member.

A photosensitive drum 101 rotated in a direction shown by the arrow R1 is uniformly charged by a charge roller 102. Then, scan exposure is effected by using a laser beam 103 ON/OFF-controlled in response to image information to form an electrostatic latent image on the photosensitive drum.

The electrostatic latent image is developed by a developing means 104. The developing means 104 includes a rotary 104A, and four developing devices mounted on the rotary. The developing devices are developing devices 104*a*, 104*b*, 104*c* and 104*d* in which yellow (first color) non-magnetic one-component toner, magenta (second color) non-magnetic one-component toner, cyan (third color) non-magnetic one-component toner, and black (fourth color) non-magnetic one component toner are contained, respectively. Each developing device has a developing roller for adhering the toner to the electrostatic latent image. By rotating the rotary 104A, the developing device selected to be used for the development of the electrostatic latent image on the photosensitive drum 101 is brought to a developing station where the developing device is opposed to the photosensitive drum 101. The above-mentioned electrostatic latent image is developed (visualized) by the developing device 104*a* with yellow toner to form an yellow (first) toner image.

The visualized first toner image is electrostatically transferred (firstly-transferred) onto a surface of an intermediate transfer belt 105 at a first toner station 106*a* where the toner image is opposed to the intermediate transfer belt 105 which is rotated in a direction shown by the arrow. After the first-transferring, a small amount of residual toner (first-transferring residual toner) remaining on the photosensitive drum 101 is removed by a cleaning device 107.

Then, the above-mentioned process is repeated regarding the remaining colors, i.e., magenta, cyan and black. In this way, a magenta (second) toner image, a cyan (third) toner image and a black (fourth) toner image are successively firstly-transferred onto the surface of the intermediate transfer belt 105 in a superimposed fashion.

Thereafter, a second transfer roller 108 which was disengaged from the surface of the intermediate transfer belt 105 (which roller can be engaged by and disengaged from the intermediate transfer belt along a direction shown by the arrow K8) is urged against the surface of the intermediate transfer belt 105 and is rotated, so that the toner images formed on the surface of the intermediate transfer belt 105 are collectively transferred (secondary-transferred) onto a surface of a transfer material P conveyed to a second transfer station 106*b* at a predetermined timing. Thereafter, the transfer material P is conveyed to a fixing device (not shown), where the toner images are fixed onto the transfer material as a permanent image. Then, the transfer material is discharged out of the apparatus.

After the secondary-transferring, a small amount of residual toner (secondary-transferring residual toner) remaining on the surface of the intermediate transfer belt 105 is removed by a cleaning roller 109 (which can be engaged by and disengaged from the intermediate transfer belt along a direction shown by the arrow K9) which is urged against the surface of the intermediate transfer belt 105 by a drive means (not shown) at a predetermined timing. The cleaning roller 109 is constituted by a core cylinder, and a conductive elastic layer coated on the core cylinder. While the toner images on the surface of the photosensitive drum 101 are being transferred onto the surface of the intermediate transfer belt 105 successively, the cleaning roller is spaced apart from the surface of the intermediate transfer belt 105, and, after the toner images on the surface of the intermediate transfer belt 105 are secondary-transferred onto the surface of the intermediate transfer belt 105 are secondary-transferred onto the surface of the transfer material P collectively, the cleaning roller is urged against (engaged by) the surface of the intermediate transfer belt 105 and bias is applied to the cleaning roller from a high voltage power source 110.

As a result, the secondary-transferring residual toner remaining on the surface of the intermediate transfer belt 105 is charged to polarity opposite to normal charging polarity of toner. At the same time, when a first color yellow toner image in a next image forming process is firstly-transferred from the surface of the photosensitive drum 101 onto the surface of the intermediate transfer belt 105, the secondary-transferring residual toner is reversely transferred from the surface of the intermediate transfer belt 105 onto the surface of the photosensitive drum 101 at the first transfer station 106*a*, thereby cleaning the surface of the intermediate transfer belt 105.

In the past, the entire longitudinal length (referred to as "effective charging area" hereinafter) of the charge roller 102 was selected to become slightly greater than a thin toner layer forming area on the surface of the developing sleeve. The reason is to prevent occurrence of the following phenomenon. That is to say, for example, in the development using a jumping developing method, since a small amount of toner is also scattered onto surface portions of the photosensitive drum outside of the thin toner layer forming area on the surface of the developing sleeve, if the charging potential of such surface portions is insufficient, the amount of the scattered toner is increased, thereby contaminating the interior of the apparatus. Further, it is practical that the cleaning roller 109 having the same configuration and construction as the charge roller 102 for charging the surface of the photosensitive drum 101 is used from the viewpoint of cost.

However, the image forming apparatus having the above-mentioned construction had the following problems.

That is to say, in order to effect the cleaning operation by using the cleaning roller 109, must be fully charged with polarity opposite to the polarity of the secondary-transferring residual toner charged by the cleaning roller 109 with polarity opposite to the normal polarity of toner. However, when the charge roller 102 and the cleaning roller 109 as described in connection with the above-mentioned conventional example are used, deformed amounts (compressed amounts) of the rollers are great at both longitudinal ends of the rollers, so that the adequate discharge area cannot be obtained. Consequently, charging ability becomes unstable, with the result that, for example, in the vicinity of ends of the areas of the surface of the intermediate transfer belt 105 against which the cleaning roller 109 is urged, the secondary-transferring residual toner which was not reversely transferred to the photosensitive drum 101 is accumulated, thereby contaminating the output print with toner.

Further, particularly in an image forming apparatus of the type in which a process cartridge integrally including the photosensitive drum and the charge roller is mounted to a main body of the apparatus having the intermediate transfer belt 105 or an intermediate transfer drum (not shown), the charge roller 102 of the process cartridge is offset from the cleaning roller 109 of the main body along the longitudinal direction. Thus, the surface of the photosensitive drum 101, the area of the surface of the photosensitive drum 101 charged by the charge roller 102 and the area of the intermediate transfer belt 105 charged by the cleaning roller 109 are not partially overlapped, thereby causing the above problem.

SUMMARY OF THE INVENTION

An object of the present invention is to provide an image forming apparatus in which residual toner remaining on an intermediate transfer member can effectively be transferred onto an image bearing member at ends of the intermediate transfer member in a rotational axial direction.

The other object of the present invention will be apparent from the following detailed explanation of the invention.

DETAILED DESCRIPTION OF THE PREFERRED EMBODIMENTS

The present invention will now be explained in connection with embodiments thereof with reference to the accompanying drawings.

<First Embodiment>

Figure 1:
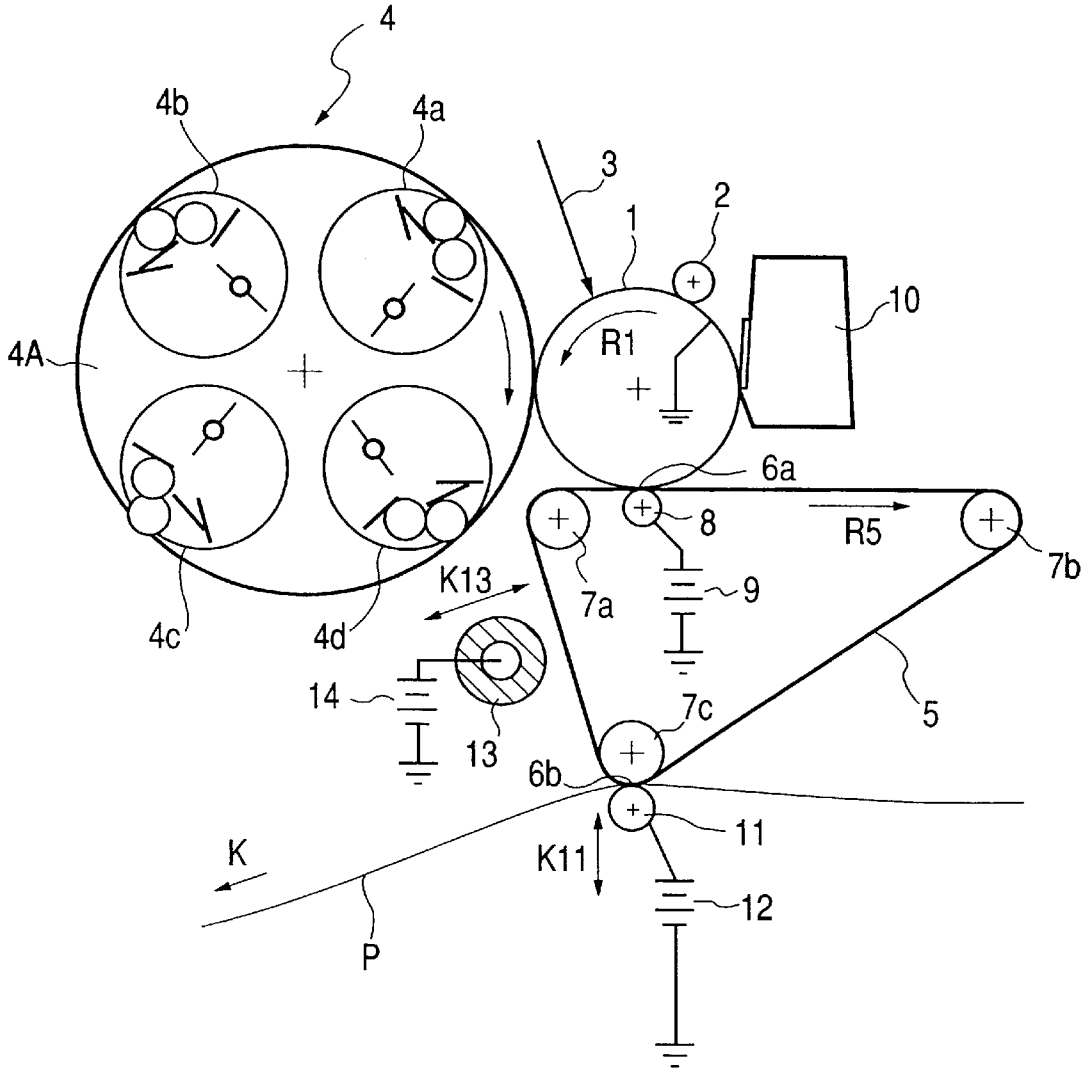
FIG. 1 is a schematic sectional view of an image forming apparatus according to a first embodiment of the present invention.

FIG. 1 shows a four color full-color laser beam printer as an example of an image forming apparatus according to the present invention.

The four color full-color laser beam printer shown in FIG. 1 (referred to as "image forming apparatus" hereinafter) has a drum-shaped electrophotographic photosensitive member as an image bearing member (referred to as "photosensitive drum" hereinafter) 1. The photosensitive drum 1 is constituted by a cylindrical aluminium substrate, and a photosensitive layer made of OPC (organic semi-photoconductor) and the like and coated on the substrate.

The photosensitive drum 1 is rotated in a direction shown by the arrow R1 at a peripheral speed of 120 mm/sec, and a surface of the photosensitive drum is uniformly charged by a charge roller (first charge member) 2 with about −700 V as dark portion potential $V_D$. Then, scan exposure is effected by using a laser beam 3 ON/OFF-controlled in response to image information to form an electrostatic latent image having bright portion potential of about −100 V on the photosensitive drum. The electrostatic latent image so formed is developed by a developing means 4. The developing means 4 includes a rotary 4A rotatable in a direction shown by the arrow, and a first developing devices 4*a* containing yellow toner as a first color, a second developing device 4*b* containing magenta toner as a second color, a third developing device 4*c* containing cyan toner as a third color and a fourth developing device 4*d* containing black toner as a fourth color, which developing devices are mounted on the rotary. First of all, the electrostatic latent image is developed (visualized) by the first developing device 4*a* containing the yellow toner as the first color. A developing method may be a jumping developing method, a two-component developing method or a FEED developing method, and combination of image exposure and inverse development is used.

Incidentally, a process cartridge including at least the photosensitive drum 1 and the charge roller 2 can detachably be mounted on a main body of the apparatus.

Figure 2:
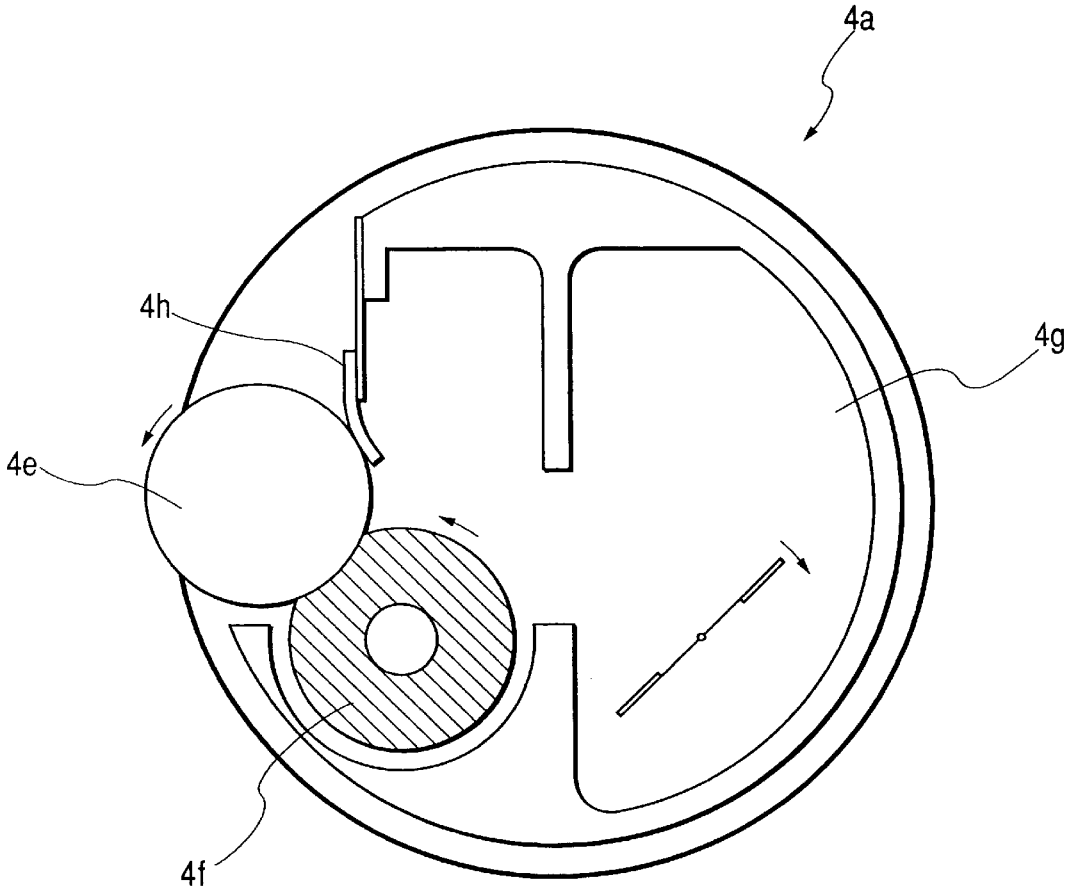
FIG. 2 is an enlarged sectional view showing a developing device.

In FIG. 2 which is a sectional view showing a schematic construction of the developing device 4*a*, the reference numeral 4*e* denotes a developing sleeve (developing member) rotated in a direction shown by the arrow; and 4*f* denotes a toner supply roller made of sponge and urged against the developing sleeve 4*e* to convey and supply the toner contained in a toner containing portion 4*g* to the developing sleeve 4*e* by rotation of the roller 4*f*. The toner supplied to the developing sleeve 4*e* is coated on a surface of the developing sleeve 4*e* as a thin toner layer by means of a developing blade (regulating member) 4*h* made of urethane rubber, for example, and, charges having predetermined negative polarity are applied to the toner by frictional charging. An area on the developing sleeve 4*e* which is coated by the toner is referred to as "toner thin layer forming area". Incidentally, the other developing devices 4*b*, 4*c*, and 4*d* have the same constructions as the developing device 4*a*.

The visualized first toner image is electrostatically transferred (firstly transferred) onto a surface of an intermediate transfer belt (intermediate transfer member) 5 rotated in a direction shown by the arrow R5 at a first transfer station (first transfer position) 6*a* where the toner image is opposed to the intermediate transfer belt 5. The intermediate transfer belt 5 is formed from an endless belt made of resin such as PVdF, PET, polycarbonate, polyethylene or silicone having a thickness of 50 to 200 $\mu$m and volume resistivity of $10^8$ to $10^{14}$ Ω·cm. Alternatively, the intermediate transfer belt may be constituted by an endless elastic substrate layer made of urethane rubber, hydrin rubber, NBR (nitrile-butadiene rubber) or EPDM (ethylene propylene diene tri-copolymer) having a thickness of 0.3 to 2 mm and volume resistivity of $10^4$ to $10^8$ Ω·cm, and a surface layer made of rubber or resin having a thickness of 2 to 100 $\mu$m and volume resistivity of $10^8$ to $10^{14}$ Ω·cm. The intermediate transfer belt 5 has a peripheral length slightly greater than a length of a maximum available transfer material P in its conveying direction and is wound around and extending between suspension rollers 7*a*, 7*b* and 7*c*. Also, the intermediate transfer belt is urged against the photosensitive drum 1 with a predetermined urging force by means of the first transfer roller 8 and is rotated at a peripheral speed substantially the same as the peripheral speed of the photosensitive drum 1 in a normal direction with respect to the rotational direction of the photosensitive drum 1. By applying predetermined voltage (first transfer bias) having polarity opposite to the normal charging polarity of toner to the toner image formed on the photosensitive drum 1 as mentioned above via the first transfer roller (first transfer means) 8 and a high voltage power source 9, the toner image is firstly-transferred onto the surface of the intermediate transfer belt 5 electrostatically. Incidentally, after the first-transferring, a small amount of residual toner (first-transferring residual toner) remaining on the surface of the photosensitive drum 1 is removed by a cleaning device 10.

Then, the above-mentioned series of processes (charging, exposure, developing, first-transferring and cleaning) are sequentially repeated regarding the remaining colors, i.e., magenta, cyan and black. In this way, a magenta (second) toner image, a cyan (third) toner image and a black (fourth) toner image are sequentially firstly-transferred onto the surface of the intermediate transfer belt 5 in a superimposed fashion. Incidentally, in the first-transferring process for each color, it is preferable that the first transfer bias applied to the first transfer roller 8 is increased by several tens of volts or several volts gradually and successively.

Thereafter, the second transfer roller 11 which was disengaged from the surface of the intermediate transfer belt 5 (which roller can be engaged by and disengaged from the intermediate transfer belt along a direction shown by the arrow K11) is urged against the surface of the intermediate transfer belt 5 with a predetermined urging force and is rotated. By applying predetermined voltage (second transfer bias) having polarity opposite to the normal charging polarity of toner to the second transfer roller 11 from a high voltage power source 12, the toner images formed on the surface of the intermediate transfer belt 5 are collectively transferred (secondary-transferred) onto a surface of a transfer material P conveyed to a second transfer station (second transfer position) 6*b* at a predetermined timing. Thereafter, the transfer material P is conveyed to a fixing device (not shown), where the toner images are fixed onto the transfer material as a permanent image. Then, the transfer material is discharged out of the apparatus.

After the secondary-transferring, a small amount of residual toner (secondary-transferring residual toner) remaining on the surface of the intermediate transfer belt 5 is removed by a cleaning roller (second charge member) 13 (which can be engaged by and disengaged from the intermediate transfer belt along a direction shown by the arrow K13) which is urged against the surface of the intermediate transfer belt 5 by a drive means (not shown) at a predetermined timing. The cleaning roller 13 is constituted by a core cylinder, a conductive elastic layer coated on the core cylinder and made of rubber or sponge having a thickness of 2 to 6 mm and volume resistivity of $10^4$ to $10^6$ Ω·cm. While the toner images on the surface of the photosensitive drum 1 are being transferred onto the surface of the intermediate transfer belt 5 successively, the roller 13 is spaced apart from the surface of the intermediate transfer belt 5, and, after the toner images on the surface of the intermediate transfer belt 5 are secondary-transferred onto the surface of the transfer material P collectively, the cleaning roller is urged against (engaged by) the surface of the intermediate transfer belt 5 and bias is applied to the cleaning roller from a high voltage power source 14.

Figure 3:
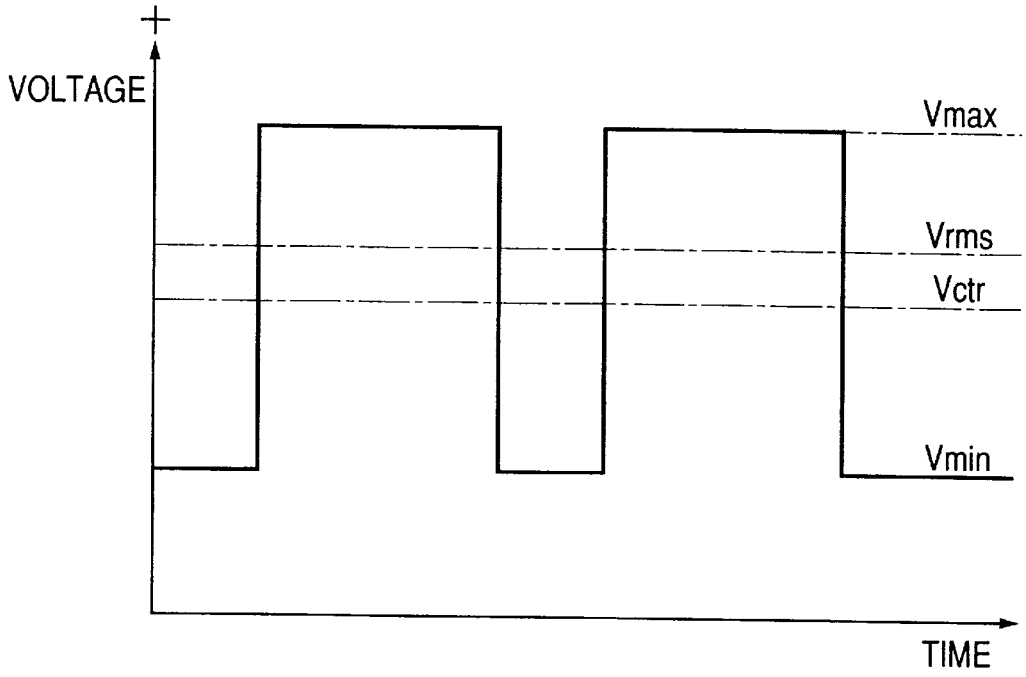
FIG. 3 is an explanatory view showing a wave form of bias applied to a cleaning roller.

It is preferable that the applied bias is an asymmetrical alternating electric field having different duty ratio as shown in FIG. 3, for example. Incidentally, in FIG. 3, "$V_{max}$" indicates a maximum value of the voltage, "$V_{min}$" indicates a minimum value of the voltage, "$V_{ctr}$" indicates an average value between the maximum value $V_{max}$ and the minimum value $V_{min}$, and "$V_{rms}$" indicates a root mean square value, so that, by applying the asymmetrical alternating electric field, the root mean square value $V_{rms}$ is deviated from the average value $V_{ctr}$.

As a result, the secondary-transferring residual toner remaining on the surface of the intermediate transfer belt 5 is charged to polarity opposite to the normal charging polarity of toner and then is reversely transferred onto the photosensitive drum 1 at the first transfer station 6*a* and, thereafter, is collected by the cleaning device 10. When the continuous image formation is effected regarding a plurality of transfer materials P, at the same time when a first color yellow toner image in a next image forming process is firstly-transferred from the surface of the photosensitive drum 1 onto the surface of the intermediate transfer belt 5 at the first transfer station 6*a*, the secondary-transferring residual toner is reversely transferred from the surface of the intermediate transfer belt 5 onto the surface of the photosensitive drum 1, thereby cleaning the surface of the intermediate transfer belt 5. With this arrangement, through-put of the image formation can be improved.

Next, the toner used in the first embodiment will be explained. The toner is manufactured by suspension polymerization, for example, and includes low softening substance of 5 to 30 weight %. The toner is non-magnetic one-component fine particle polymerized toner including substantially round particles having shape coefficient SF1 of 100 to 120, shape coefficient SF2 of 100 to 120 and particle diameter of 5 to 7 μm.

Figure 4:
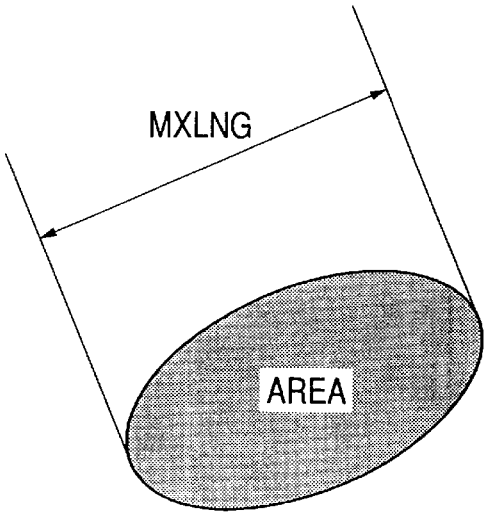
FIG. 4 is an explanatory view for explaining a shape coefficient SF1.

Incidentally, as shown in FIG. 4, the shape coefficient SF1 is a value representative of a rate of roundness of a spherical substance and is represented by a value obtained by dividing square of a maximum length MXLNG of an elliptical profile (obtained by projecting the spherical substance onto a two-dimensional plane) by a profile area AREA and by multiplying it by 100π/4. That is to say, the shape coefficient SF1 is defined by the following equation:

$$SF1=\{(MXLNG)^2/AREA\}\times(100\pi/4).$$

Figure 5:
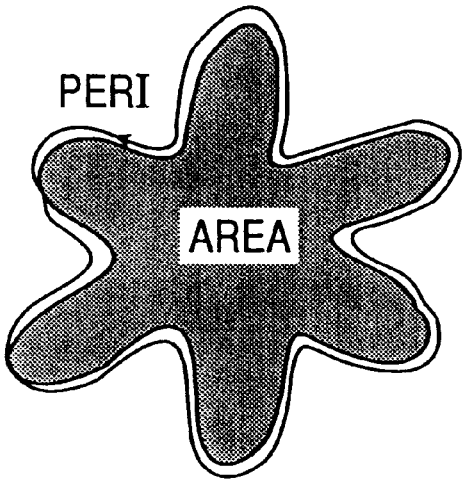
FIG. 5 is an explanatory view for explaining a shape coefficient SF2.

On the other hand, as shown in FIG. 5, the shape coefficient SF2 is a value representative of a rate of unevenness of the configuration of the substance and is represented by a value obtained by dividing square of a peripheral length PERI of a profile (obtained by projecting the substance onto a two-dimensional plane) by a profile area AREA and by multiplying it by 100π/4. That is to say, the shape coefficient SF2 is defined by the following equation:

$$SF2=\{(PERI)^2/AREA\}\times(100\pi/4).$$

In the first embodiment, by using FE-SEM (S-800) manufactured by Hitachi Seisakusho Co., Ltd, sampling of toner images is effected by 100 times at random and image informations thereof are introduced into an image analyzing device manufactured by Nicole Co. (LUSEX 3) through an interface to analyze the image informations, and the shape coefficients are calculated by using the above equations.

Figure 6:
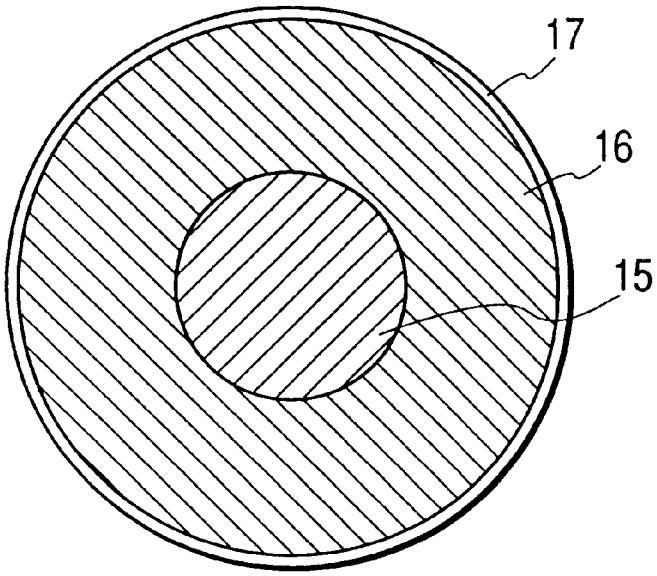
FIG. 6 is a schematic view showing polymerized toner.

The polymerized toner is schematically shown in FIG. 6. The polymerized toner takes a substantially spherical shape due to its manufacturing method. A core 15 includes wax of ester group, a resin layer 16 is made of styrene-butyl acrylate, and a surface layer 17 is made of styrene-polyester. Specific weight of the toner is about 1.05. As mentioned above, by incorporating the wax into the core 15, the offset preventing effect in the fixing operation can be obtained, and, by providing the resin layer as the surface layer 17, the charging efficiency can be improved. Further, oil treating silica is added to stabilize tribo (Q/M) so that the tribo becomes about −10 $\mu$C/g.

Now, disposition of the charge roller 2, developing sleeve 4*e* and cleaning roller 13 in a longitudinal direction (direction along a rotational axial direction) will be explained.

Figure 7:
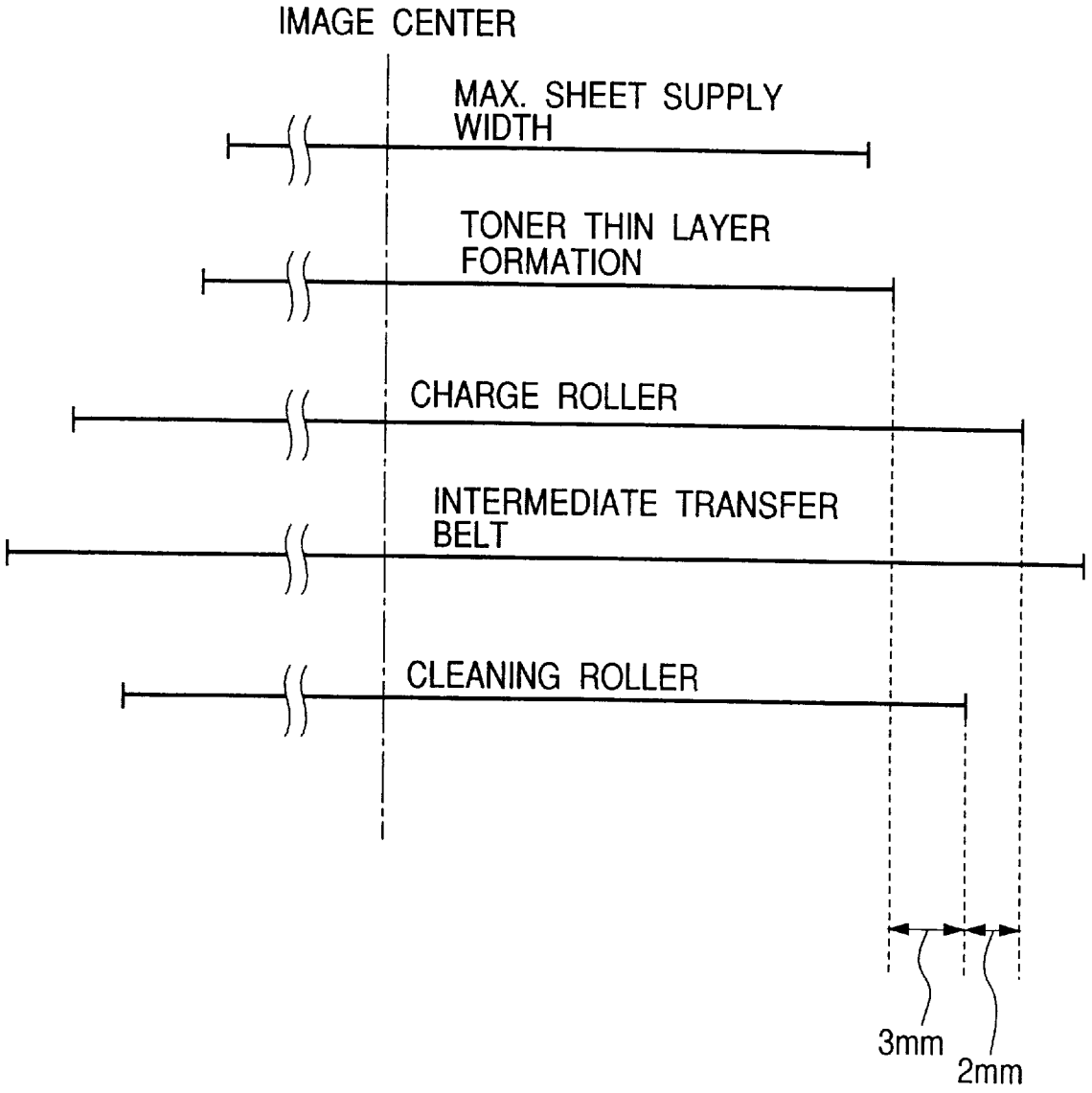
FIG. 7 is an explanatory view showing areas of various members according to the first embodiment.

In the first embodiment, as shown in FIG. 7, the area of the surface of the intermediate transfer belt 5 which is charged by the cleaning roller 13 is disposed internally of the area of the surface of the photosensitive drum 1 which is charged by the charge roller 2, and the toner thin layer forming area of the surface of the developing sleeve 4*e* is disposed internally of the area of the surface of the intermediate transfer belt 5 which is charged by the cleaning roller 13. More specifically, for a maximum sheet supply width of 216 mm of the image forming apparatus (in a direction perpendicular to the conveying direction for the transfer material P), the toner thin layer forming area of the surface of the developing sleeve 4*e* is selected to 218 mm, the area of the surface of the intermediate transfer belt 5 which is charged by the cleaning roller 13 is selected to 224 mm, the area of the surface of the photosensitive drum 1 which is charged by the charge roller 2 is selected to 228 mm, and these areas are arranged symmetrically with respect to an image center. With this arrangement, the area of the surface of the intermediate transfer belt 5 which is charged by the cleaning roller 13 is greater than the toner thin layer forming area of the surface of the developing sleeve 4*e* by 3 mm at each side (end), and the area of the surface of the photosensitive drum 1 which is charged by the charge roller 2 is greater than the area of the surface of the intermediate transfer belt 5 which is charged by the cleaning roller 13 by 2 mm at each side (end).

Now, test results regarding the cleaning ability of the intermediate transfer belt 5 according to the illustrated embodiment will be discussed. In the tests, in order to compare the cleaning abilities of the intermediate transfer belts 5, endurance data were collected when image formation was effected continuously regarding a plurality of transfer materials P by using a conventional image forming apparatus (as shown in FIG. 8) using a roller having the same configuration and construction as the charge roller 2 as the cleaning roller 13 (in which, although the toner thin layer forming area of the surface of the developing sleeve was selected to 218 mm, the area of the surface of the intermediate transfer belt which is charged by the cleaning roller and the area of the surface of the photosensitive drum which is charged by the charge roller were selected to 224 mm, and these areas were arranged symmetrically with respect to the image center) and the image forming apparatus shown in the first embodiment (in which the area of the surface of the intermediate transfer belt which is charged by the cleaning roller 13 was disposed internally of the area of the surface of the photosensitive drum which is charged by the charge roller 2 and the toner thin layer forming area of the surface of the developing sleeve was disposed internally of the area of the surface of the intermediate transfer belt which is charged by the cleaning roller 13).

Figure 8:
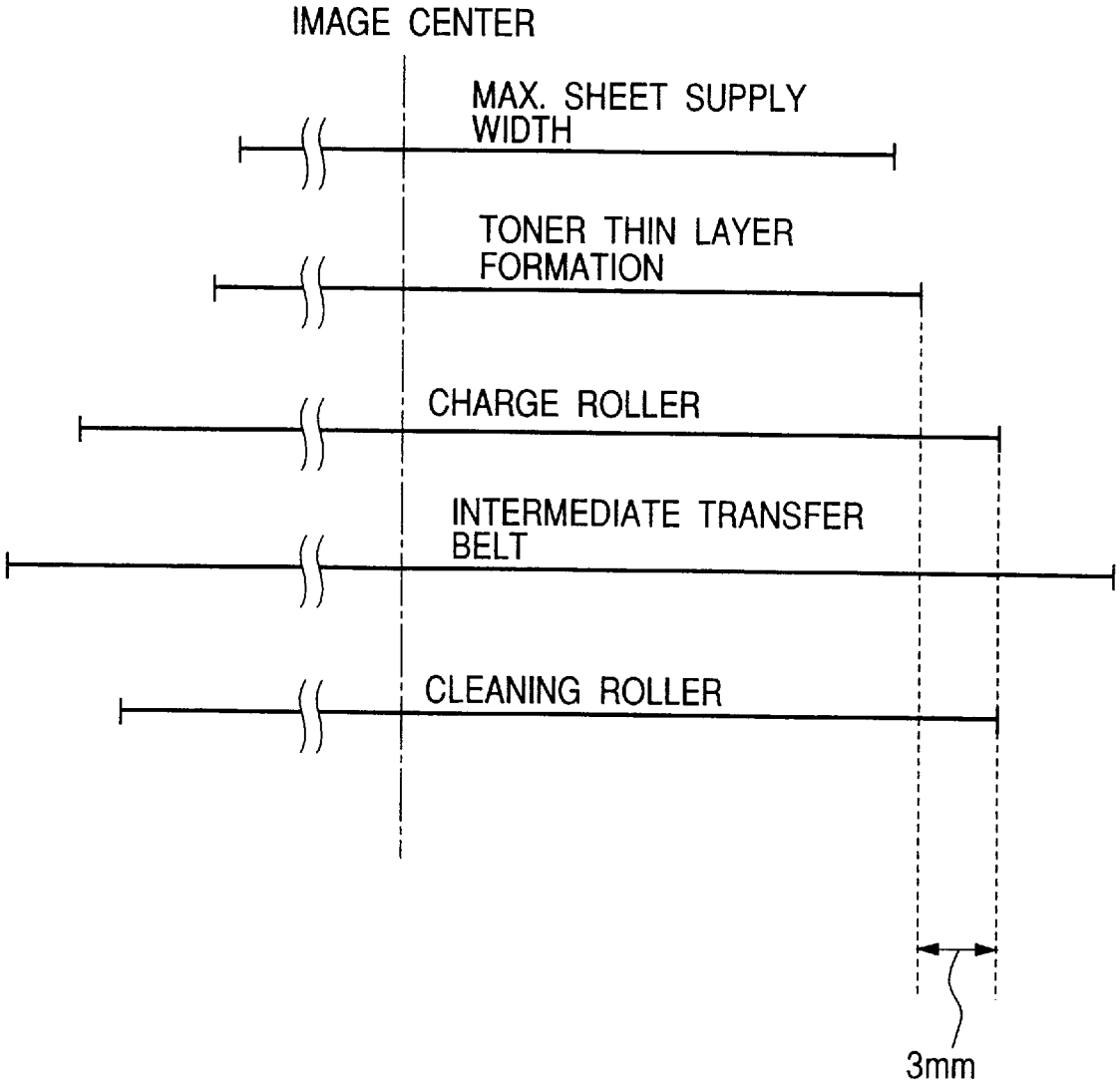
FIG. 8 is an explanatory view showing areas of conventional various members.

According to the test results, in the conventional arrangement shown in FIG. 8, it was found that, at the time when the image formation of about 1000 sheets was completed, the toner contamination begins to occur at the ends of the output image on the transfer material P, and, observing the intermediate transfer belt 5, it was ascertained that the secondary-transferring residual toner (which was not reversely transferred to the surface of the photosensitive drum) is accumulated in the vicinity of the ends of the intermediate transfer belt 5 and contaminates therearound. To the contrary, in the first embodiment shown in FIG. 7, it was found that, even at the time when the image formation of about 1000 sheets was completed, the poor image is not produced, and, observing the intermediate transfer belt 5, it was ascertained that the toner contamination and toner accumulation do not occur throughout the belt to achieve the good result.

As mentioned above, by adopting the arrangement in which the area of the surface of the intermediate transfer belt 5 which is charged by the cleaning roller 13 is disposed internally of the area of the surface of the photosensitive drum 1 which is charged by the charge roller 2 and the toner thin layer forming area of the surface of the developing sleeve 4*e* is disposed internally of the area of the surface of the intermediate transfer belt 5 which is charged by the cleaning roller 13, the good cleaning ability can be maintained in the entire longitudinal area of the intermediate transfer belt 5, thereby obtaining the good full-color image.

Incidentally, in the first embodiment, while an example that the area of the surface of the intermediate transfer belt charged by the cleaning roller 13 is greater than the toner thin layer forming area of the surface of the developing sleeve by 3 mm at each side (end) and the area of the surface of the photosensitive drum charged by the charge roller 2 is greater than the area of the surface of the intermediate transfer belt charged by the cleaning roller 13 by 2 mm at each side (end) was explained, the present invention is not limited to such an example. But, it is preferable that the former is selected to 2 mm at the minimum and the latter is selected to 1 mm at the minimum in order to achieve the good performance without making the entire apparatus bulky. Further, in the illustrated embodiment, while an example that the areas are arranged symmetrically with respect to the image center was explained, so long as the above-mentioned minimum 2 mm and minimum 1 mm are ensured, the areas are not necessarily arranged symmetrically with respect to the image center.

<Second Embodiment>

Next, a second embodiment of the present invention will be explained. Same elements as those in the first embodiment are designated by the same reference numerals and explanation thereof will be omitted. In the second embodiment, an intermediate transfer drum is used as the intermediate transfer member. The intermediate transfer drum 18 is constituted by a cylinder made of aluminium and the like, and a resin layer as described in connection with the first embodiment or a resin layer coated on an elastic substrate layer.

Figure 9:
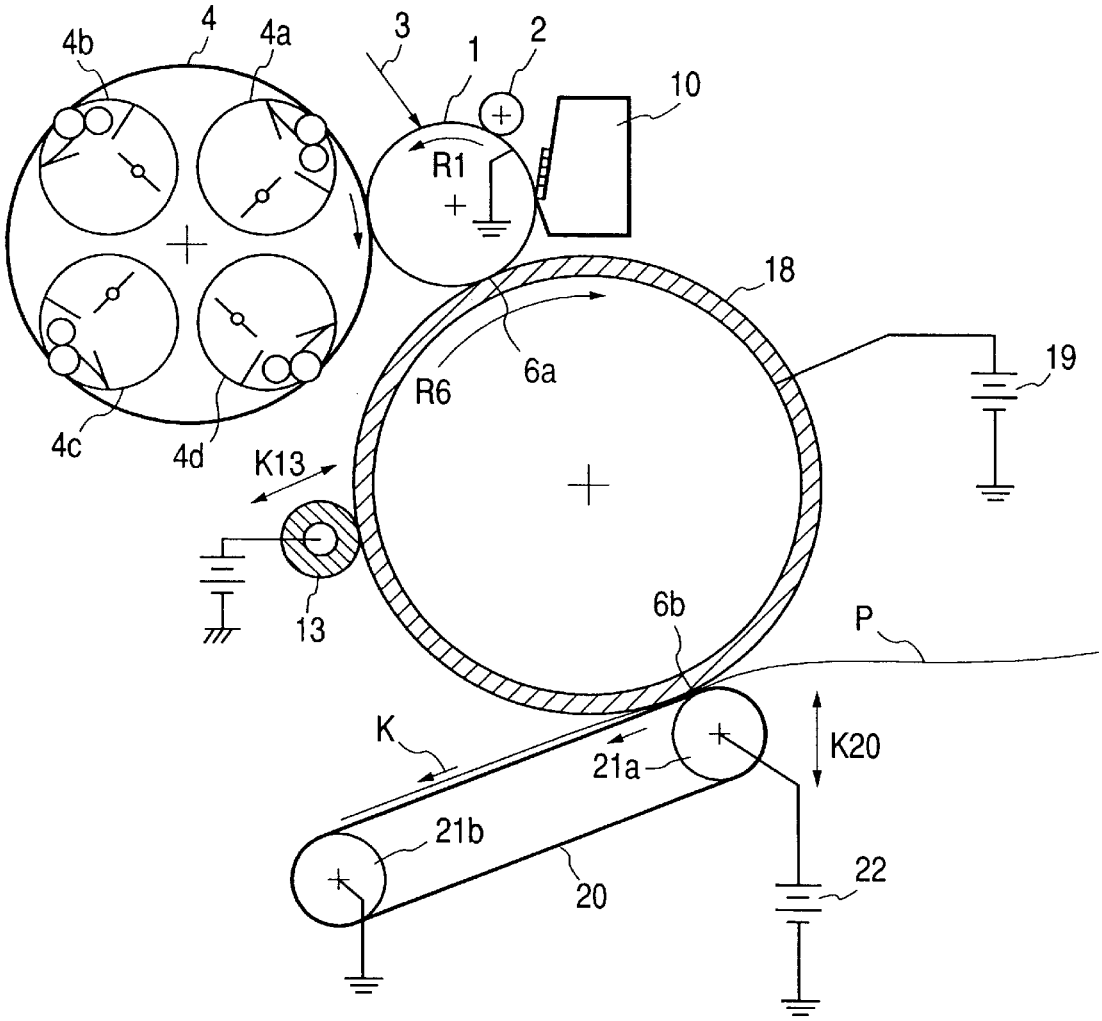
FIG. 9 is a schematic sectional view of an image forming apparatus according to a second embodiment of the present invention.

Explaining with reference to FIG. 9, the toner image formed on the surface of the photosensitive drum 1 is firstly-transferred onto a surface of the intermediate transfer drum (intermediate transfer member) 18 by applying voltage (first transfer bias) having polarity opposite to the normal charging polarity of toner from a high voltage power source (first transfer means) 19. then, when a full-color image comprised of four color toner images is formed on the surface of the intermediate transfer drum 18 by repeating the above-mentioned firstly-transferring process by three times, a second transfer belt (second transfer means) 20 which was disengaged from the surface of the intermediate transfer drum 18 is shifted upwardly in a direction shown by the double-headed arrow K20 to be urged against the surface of the intermediate transfer drum 18 with a predetermined urging force and is rotated. The transfer belt 20 is supported by a bias roller 21*a* and a tension roller 21*b*, and voltage (second transfer bias) having polarity opposite to the normal charging polarity of toner is applied from a high voltage power source 22 to the bias roller 21*a*, with the result that the toner images are collectively secondary-transferred onto the surface of the transfer material P conveyed at a predetermined timing.

Figure 10:
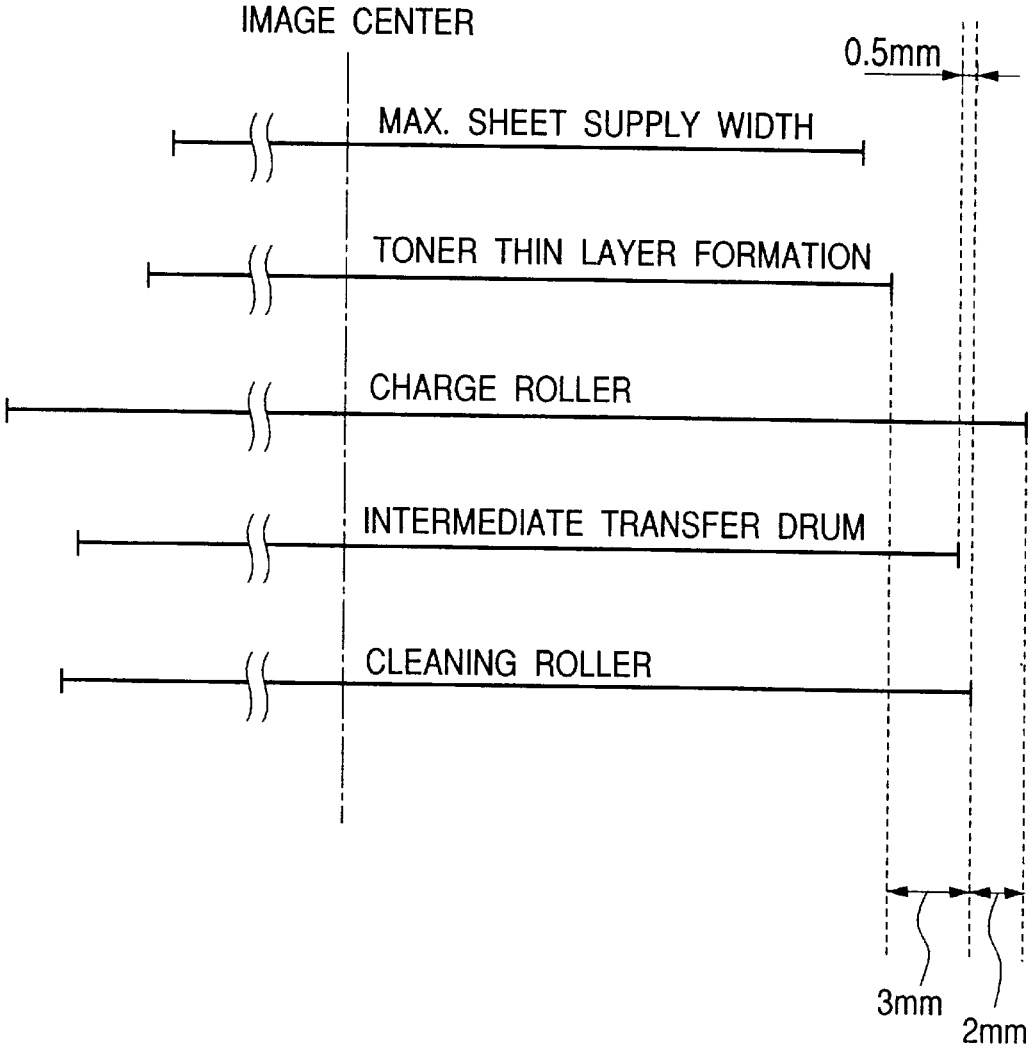
FIG. 10 is an explanatory view showing areas of various members according to the second embodiment.
Figure 11:
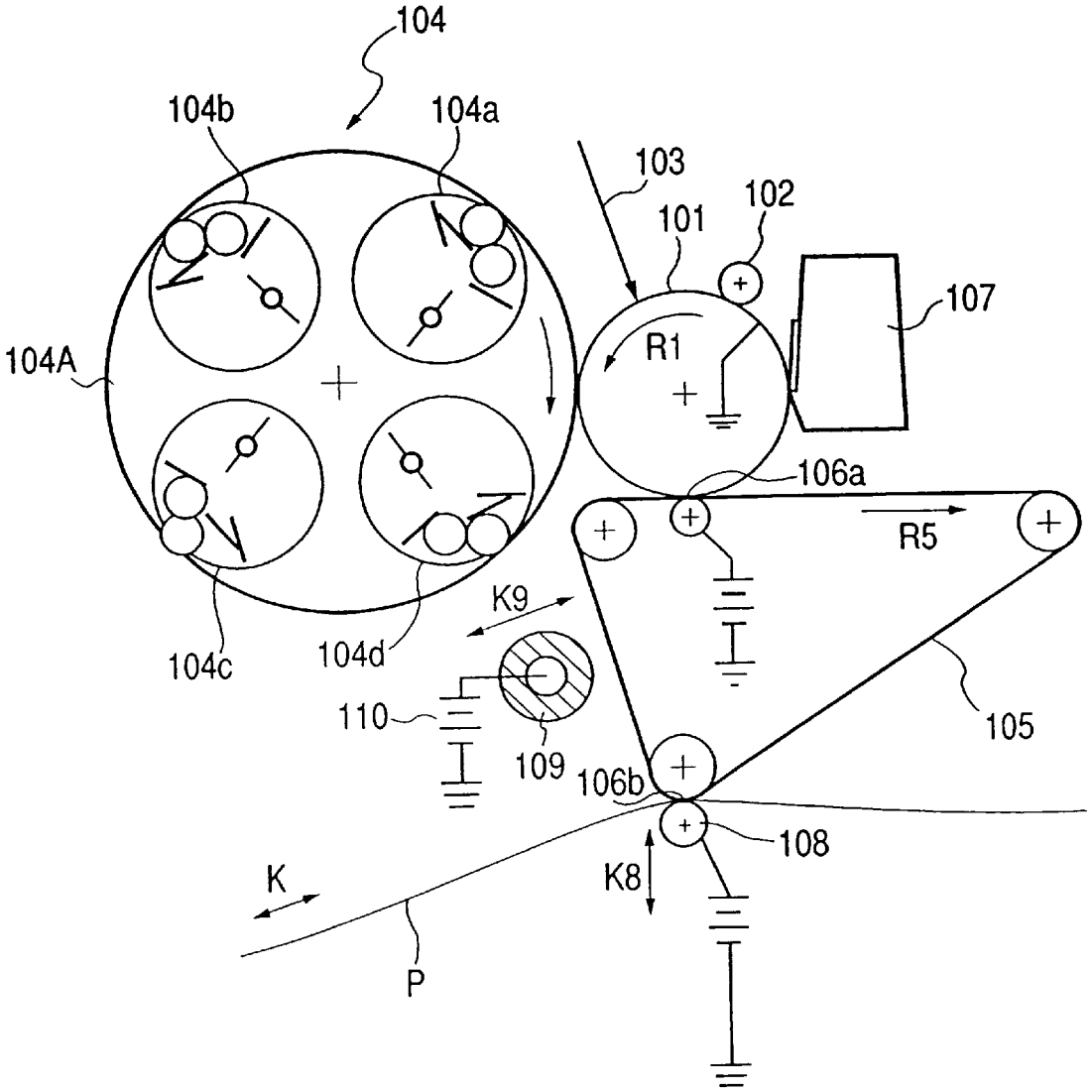
FIG. 11 PRIOR ART
FIG. 11 is a schematic sectional view of a conventional image forming apparatus.

In the second embodiment, as shown in FIG. 10, in order to ensure that the entire longitudinal area of the intermediate transfer drum 18 is adequately charged by the cleaning roller 13, the entire longitudinal length of the intermediate transfer drum 18 is selected to become smaller than the entire longitudinal length of the cleaning roller 13. More specifically, the entire length of the cleaning roller 13 is selected to 224 mm and the entire length of the intermediate transfer drum 18 is selected to 223 mm. In case of the intermediate transfer belt 5 shown in the first embodiment, when the belt is rotatingly driven, the intermediate transfer belt 5 is apt to be "offset" along the longitudinal direction thereof, and, in order to prevent such offset, for example, ribs must be provided at both longitudinal ends or edges of the belt, and, thus, it is difficult to shorten the entire longitudinal length of the belt to reserve a space for the ribs.

To the contrary, in case of the intermediate transfer drum 18 according to the second embodiment, since such offset is not generated, it is possible to shorten the entire longitudinal length of the belt. As a result, the entire longitudinal area of the surface of the intermediate transfer belt 18 is adequately charged by the cleaning roller 13, and, accordingly, the secondary-transferring residual toner is adequately charged. Thus, the good cleaning ability of the entire longitudinal area of the surface of the intermediate transfer belt 18 can be maintained to obtain the good full-color image, and the longitudinal dimension of the entire apparatus can be made smaller.

Incidentally, in the second embodiment while an example that the area of the surface of the intermediate transfer drum 18 charged by the cleaning roller 13 is greater than the toner thin layer forming area of the surface of the developing sleeve 4*e* by 3 mm at each side (end), and the area of the surface of the photosensitive drum 1 charged by the charge roller 2 is greater than the area of the surface of the intermediate transfer drum 18 charged by the cleaning roller 13 by 2 mm at each side (end) was explained, the present invention is not limited to such an example. But, it is preferable that the former is selected to 2 mm at the minimum and the latter is selected to 1 mm at the minimum in order to achieve the good performance without making the entire apparatus bulky. Further, in the illustrated embodiment, while an example that the areas are arranged symmetrically with respect to the image center was explained, so long as the above-mentioned minimum 2 mm and minimum 1 mm are ensured, the areas are not necessarily arranged symmetrically with respect to the image center.

What is claimed is:

1. An image forming apparatus comprising:

an image bearing member;

image forming means for forming a toner image on said image bearing member and having a first charge member for charging said image bearing member;

an intermediate transfer member onto which the toner image on said image bearing member is transferred at a transfer position, the toner image on said intermediate transfer member being transferred onto a transfer material; and a second charge member for charging residual toner remaining on said intermediate transfer member, said second charge member charging the residual toner on said intermediate transfer member with a polarity opposite to a charging polarity of said first charge member for charging said image bearing member, after the toner image is transferred from said intermediate transfer member to the transfer material;

wherein at said transfer position, an electric field for transferring the residual toner on said intermediate transfer member charged by said second charge member onto said image bearing member is generated, and a charging area in which the residual toner is charged by said second charge member in a longitudinal direction of said second charge member is disposed within a charging area in which said image bearing member is charged by said first charge member in a longitudinal direction of said first charge member.

2. An image forming apparatus according to claim 1, wherein the longitudinal charging area of said second charge member is disposed internally of the longitudinal charging area of said first charge member by at least 1 mm at both ends thereof.

3. An image forming apparatus according to claim 1, further comprising a transfer means for applying voltage to said intermediate transfer member in order to transfer the toner image on said image bearing member onto said intermediate transfer member at said transfer position.

4. An image forming apparatus according to claim 3, wherein said transfer means generates an electric field by which, at said transfer position, a next toner image on said image bearing member is transferred onto said intermediate transfer member, at the same time when the residual toner charged by said second charge member is transferred from said intermediate transfer member onto said image bearing member.

5. An image forming apparatus according to claim 4, wherein polarity of the voltage applied to said first charge member is the same polarity as normal charging polarity of the toner.

6. An image forming apparatus according to claim 4, further comprising a cleaning means for cleaning said image bearing member.

7. An image forming apparatus according to claim 1, wherein said image forming means has a developing member for bearing the toner and developing a latent image on said image bearing member.

8. An image forming apparatus according to claim 7, wherein a longitudinal toner bearing area of said developing member is disposed internally of said longitudinal charging area of said second charge member.

9. An image forming apparatus according to claim 8, wherein said longitudinal toner bearing area of said developing member is disposed internally of said longitudinal charging area of said second charge member by at least 2 mm at both ends.

10. An image forming apparatus according to claim 1, further comprising a unit having said image bearing member and said first charge member, and can detachably be mounted to a main body of said image forming apparatus.

11. An image forming apparatus according to claim 1, wherein said first charge member abuts against said image bearing member.

12. An image forming apparatus according to claim 11, wherein said first charge member has a roller.

13. An image forming apparatus according to claim 1, wherein said second charge member can be urged against said intermediate transfer member when the residual toner is charged.

14. An image forming apparatus according to claim 13, wherein voltage obtained by overlapping DC voltage with AC voltage is applied to said second charge member.

15. An image forming apparatus according to claim 1, wherein said second charge member charges an overall length of said intermediate transfer member in a direction perpendicular to a rotational direction of said intermediate transfer member.

16. An image forming apparatus according to claim 15, wherein said second charge member has a roller.

17. An image forming apparatus according to claim 1, wherein said image bearing member can bear a plural color toner images to be sequentially transferred onto said intermediate transfer member in a superimposed fashion at said transfer position, and then transferred onto the transfer material.

* * * * *

UNITED STATES PATENT AND TRADEMARK OFFICE

CERTIFICATE OF CORRECTION

PATENT NO. : 5,999,784

DATED : December 7, 1999

INVENTOR(S): SHINICHI TSUKIDA, ET AL.

It is certified that error appears in the above-identified patent and that said Letters Patent is hereby corrected as shown below:

COLUMN 1,
Line 38, "an" should read --a--.

COLUMN 3,
Line 45, "conven-" should read --various--; and
Line 46, "tional various" should read --conventional--.

Signed and Sealed this

Twelfth Day of December, 2000

*Attest:*

Q. TODD DICKINSON

*Attesting Officer*

*Director of Patents and Trademarks*